US012486653B2

(12) United States Patent
Delaney

(10) Patent No.: US 12,486,653 B2
(45) **Date of Patent: *Dec. 2, 2025**

(54) WASTE OUTLET

(71) Applicant: ELLSI LIMITED, Flixborough (GB)

(72) Inventor: Paul Delaney, Flixborough (GB)

(73) Assignee: ELLSI LIMITED, Flixborough (GB)

( * ) Notice: Subject to any disclaimer, the term of this patent is extended or adjusted under 35 U.S.C. 154(b) by 11 days.

This patent is subject to a terminal disclaimer.

(21) Appl. No.: 18/466,936

(22) Filed: Sep. 14, 2023

(65) Prior Publication Data

US 2023/0417030 A1 Dec. 28, 2023

Related U.S. Application Data

(63) Continuation of application No. 18/055,528, filed on Nov. 15, 2022, now Pat. No. 11,814,831.

(30) Foreign Application Priority Data

Nov. 15, 2021 (GB) ..... 2116416

(51) Int. Cl.
*E03C 1/22* (2006.01)

(52) U.S. Cl.
CPC ..... *E03C 1/22* (2013.01)

(58) Field of Classification Search
CPC ... E03C 1/182; E03C 1/20; E03C 1/22; E03C 1/23; E03C 1/2306; E03C 1/232; E03C 1/24; E03C 1/26–266; E03C 2001/2311–2317; E03C 2201/90; E03D 11/16–17; E03F 5/0407–0408
See application file for complete search history.

(56) References Cited

U.S. PATENT DOCUMENTS

| | | | | |
|---|---|---|---|---|
| 3,140,104 | A * | 7/1964 | Cosper | E03D 11/16 285/59 |
| 3,881,201 | A * | 5/1975 | Richards | E03C 1/22 4/286 |
| 4,648,140 | A * | 3/1987 | Bogusz | E03C 1/244 4/654 |
| 5,165,118 | A | 11/1992 | Cendrowski | |
| 5,369,815 | A * | 12/1994 | Martin | A47K 1/14 4/287 |
| 6,430,756 | B1 * | 8/2002 | Reilly | E03D 11/16 411/395 |
| 8,496,811 | B2 | 7/2013 | Cohen | |
| 8,621,683 | B2 | 1/2014 | Coronado et al. | |
| 11,814,831 | B2 * | 11/2023 | Delaney | E03C 1/232 |
| 2006/0038047 | A1 | 2/2006 | Anderson et al. | |
| 2009/0151060 | A1 * | 6/2009 | Zubillaga | E03C 1/262 4/292 |

* cited by examiner

*Primary Examiner* — David P Angwin
*Assistant Examiner* — Nicholas A Ros
(74) *Attorney, Agent, or Firm* — Renner, Otto, Boisselle & Sklar, LLP

(57) ABSTRACT

A waste outlet having a top section, with an inlet and an outlet, and a bottom section, with an inlet and an outlet. The top section and the bottom section are both mounted upon a substantially elongate member. A tubular seal element encloses the outlet of the top section and the inlet of the bottom section and one of the top section and the bottom section is connected to the elongate member and the other of the top section and the bottom section is slidably mounted on the rigid elongate member so that it can slide therealong to adjust the distance between the respective sections.

13 Claims, 5 Drawing Sheets

WASTE OUTLET

RELATED APPLICATIONS

This application is a Continuation and claims priority of U.S. application Ser. No. 18/055,528, filed Nov. 15, 2022, which claims priority of United Kingdom Application No. 2116416.5, filed Nov. 15, 2021, each of which is hereby incorporated herein by reference in its entirety.

FIELD OF THE INVENTION

The invention relates to a waste outlet, particularly for use in plumbing arrangements, for example, in basins, sinks, baths and showers.

BACKGROUND TO THE INVENTION

Waste outlets are required in many plumbing systems, for example, in sinks, baths and showers to drain wastewater away. Such waste outlets are fitted into apertures that are either drilled or cast into the product and the waste outlet often has a first section and a second section that are affixed to one another. In order to install the waste outlet, access is required to both sides of the aperture so that silicone sealant can be applied to both sides of the aperture, so that the top section can be located in the aperture and then the second section is connected to the first section from the other side of the aperture, oftentimes by way of a threaded connection.

Where the waste outlet can be fitted prior to the product being installed, the fixing of the waste outlet to the product is less complicated, although it will often require two people; however, where the waste outlet is being replaced on a product that is in situ, the installation process is more complex and requires two people and/or considerable effort in installing the new part.

SUMMARY OF THE INVENTION

Accordingly, the present invention is directed to a waste outlet device having:

- a top section with an inlet and an outlet, the inlet and the outlet of the top section being in fluid communication with one another; and
- a bottom section with an inlet and an outlet, the inlet and the outlet of the bottom section being in fluid communication with one another, with the bottom section further having a support section therein;
- wherein the top section and the bottom section are both arranged, and preferably mounted, upon a substantially elongate member,
- wherein a tubular seal element encloses the outlet of the top section and the inlet of the bottom section, and
- wherein the top section and the bottom section are arranged on the elongate member such that the distance between the top section and the bottom section can be adjusted, which can compress or expand the tubular seal between the top section and the bottom section.

Thus, the present invention comprises a top section and a bottom section that are mounted on, and can be connected by, an elongate member, or shaft, and the seal section is arranged therebetween. The elongate member may be substantially rigid. The relative axial movement along the elongate member, between the top section and the bottom section, adjusts the shape and the width of the tubular seal and the waste outlet device can be locked into a product to provide an outlet for waste fluid.

The tubular seal, which is preferably elastomeric material or rubber, may be provided with creases, ribs, folds or other elements that encourage a predetermined deformation upon compression of the tubular seal. Thus, the tubular seal may fold, or concertina in a known manner, preferably with the excess material moving radially away from the axis of the tubular seal, thereby leaving the internal channel of the tubular seal relatively unobstructed. The tubular seal surrounds the periphery of the outlet of the top section so that liquid passing therethrough will enter into the tubular seal and pass through to the inlet of the bottom section. It will be appreciated that the top section may not be positioned inside the tubular seal but may drain into the tubular seal. For example, the top section may be cup-shaped or may be substantially planar, and in either case the outlet of the top section will be enclosed by the tubular seal to allow liquid to pass from the top section into the tubular seal.

Advantageously, the tubular seal has an extended position when the top section and bottom section are spaced apart, and a compressed position in which the top section and bottom section are brought closer to one another to compress the seal section and wherein, when in the compressed position, the seal has a larger width than when in the extended position.

The present invention allows for the seal to be placed into the extended position when the top section and the bottom section are moved apart and into a compressed position when the top section and the bottom section are brought together. As a result, the seal section can be narrowed to allow the bottom section to pass through the aperture in which it is to be fitted and, once the top section and bottom section are on respective sides of the aperture, the device can be manipulated into the compressed position. As the seal section increases in width, or expands radially, which may be due to it concertinaing, the waste outlet device becomes fixed in the aperture. The device can then be locked in place to prevent inadvertent removal or displacement. It will be appreciated that the increased width of the seal is, preferably, positioned on the outlet side of the aperture, which is to say, on the side through which water drains into a waste pipe, rather than proximal the source of water.

In one arrangement, the elongate member is provided with an external threaded portion and at least one of the bottom section and the top section is provided with a corresponding threaded section such that rotation of the elongate member adjusts the position of the top section and/or the bottom section relative to the other of the top section and/or the bottom section.

The use of a threaded section, which is preferably controlled from the water source side of the top section, allows for a good level of control over the position of the respective parts along the elongate member, especially the bottom section relative to the top section. Thus, the parts can be brought together to move the seal into the compressed position in a controlled and predictable manner. The elongate member may, itself, rotate, or it may be that a sleeve is supplied therearound that is provided with the threaded section and that rotates. Accordingly, there the elongate member may be provided with an aperture, or recess, in which to receive a tool to rotate the elongate member. The tool may be in the form of a screwdriver, a hex key, a spanner or another tool that can engage the elongate member and rotate it. The elongate member may be shaped to accept more than one tool, for example, it may have a profile for a spanner and a slot for a flat-head screwdriver.

It will be appreciated that the rotational freedom of the bottom section will be limited by the tubular seal; however, it may be preferable to provide a further mechanism to reduce or prevent rotation of the bottom section relative to the top section, for example, one, two, three or more guide shafts between the two sections that may be positioned radially around the longitudinal axis of the water outlet device. Such guides may be fixedly connected to the top section, whilst the bottom section is able to slide or move along the same. Thus, the guides allow for relative movement between the parts, whilst reducing or preventing relative rotational movement between the two parts.

Alternatively, or additionally, the waste outlet is biased into either the compressed position or the extended position and, optionally, the bias may be in the form of a spring-bias. A compression or extension spring may be applied internally or externally to the elongate member to bias the top section and the bottom section to either the compressed position or the extended position. Thus, in order to move the device into the other position of the compressed position and the extended position, a force must be provided in the opposition direction. To that end, the force may be provided by way of a tool, which may be specific to the waste outlet or a regular tool, such as a screwdriver. The tool can be pushed through an aperture in the top section to force the bottom section away from the top section, thereby placing the tubular seal into the extended position.

In one embodiment, the top section is provided with a radially extending flange. The flange on the top section is, preferably, wider than the diameter of the aperture in which the waste outlet is being fitted, thereby preventing the top section from passing through the aperture. The flange may extend around the perimeter of the top section, or it may extend only partially therearound. It is also particularly advantageous that the tubular seal is provided with a top lip or flange, which is preferably radially extending. By providing a lip or flange to the seal, the top of the seal is more securely sandwiched between the top section and the surface to which the device is being fitted.

Preferably, the elongate member has a channel therethrough. Whilst the elongate member may be solid, providing a channel through the elongate member allows fluid to pass therethrough. Furthermore, the substantially elongate member may have a head section and a stem section and part of the head section adjacent the stem may be provided with a flange or skirt. Advantageously, the underside of the flange or skirt is provided with a curved profile.

The flange or skirt of the bolt reduces the risk of a spanner or other tool from scratching the internal surface of the waste outlet device during installation. Similarly, the radius on the underside of the flange reduces the risk of visible scratched on the device during installation. The elongate member, or bolt, may be used independently of the waste outlet device and may have other applications.

In one arrangement, the top section is provided with an aperture through which the substantially elongate member can pass or engage. The top section may have an aperture through which the elongate member can be positioned. In such an arrangement, the top section acts in a similar manner to a washer; being mounted upon the elongate member, but not engaging therewith so that rotation of the elongate member does not rotate the top member.

Preferably, the bottom section is provided with a U-shaped rim surrounding the inlet of the bottom section, and one end of the tubular seal sits within the U-shaped rim. By having a rim in which the tubular seal can sit, when in the compressed position, the tubular seal forms a good seal with the bottom section to reduce the risk of leaking. Alternatively, or additionally, the tubular seal and the bottom section may fixedly connected, for example, they may be formed integrally with one another or connected to one another with adhesive.

The present invention extends to a method of installing a waste outlet comprising the steps of:

providing a waste outlet according to any preceding claim;

putting the waste outlet into the extended position;

placing the waste outlet device into an aperture with the lower section on one side of the aperture and the upper section on the opposite side of an aperture;

adjusting the waste outlet into the compressed position.

The adjustment of the waste outlet into the compressed position may involve manipulation, movement or other action that allows the top section and the bottom section to move closer together. This may involve the application of a force to move the parts closer to one another or the removal of a force, which may be applicable where a bias is involved.

When the device is installed into a surface that has an aperture therein, due to the compressive forces acting upon the tubular seal, the tubular seal can form a substantially rigid seal adjacent the surface to reduce the risk of water leaking. In such an arrangement, the tubular seal, when put into the compressed position, is sandwiched between the top section and a first side of the surface and between the bottom section and a second side of the surface. Thus, the tubular seal can form a substantially watertight conduit through the surface. The tubular seal may be compressed in a concertina manner and held tight by the elongate member or biasing means on the second side.

When installed, liquid can flow through the surface from the inlet of the top section, through the aperture and out of the outlet of the second section.

The present invention also extends to a sink, shower tray or bath having a waste outlet as set out herein. It will be appreciated that the device may be installed in a substantially vertical position, such as in the main drain for a sink or bath or in the shower tray, and that it may also be installed in a substantially horizontal position, for example in a bath or sink overflow. Clearly, when installed horizontally, the top section and the bottom section may be considered a first section and a second section, respectively, rather than top section and bottom section. It will further be appreciated that such a waste outlet can be installed into an electrical device, such as a waste disposal, a dishwasher or a washing machine.

BRIEF DESCRIPTION OF THE DRAWINGS

Embodiments of the invention will now be described, by way of example only, and with reference to the accompanying drawings, in which.

DETAILED DESCRIPTION OF EXEMPLARY EMBODIMENTS

Figure 1:
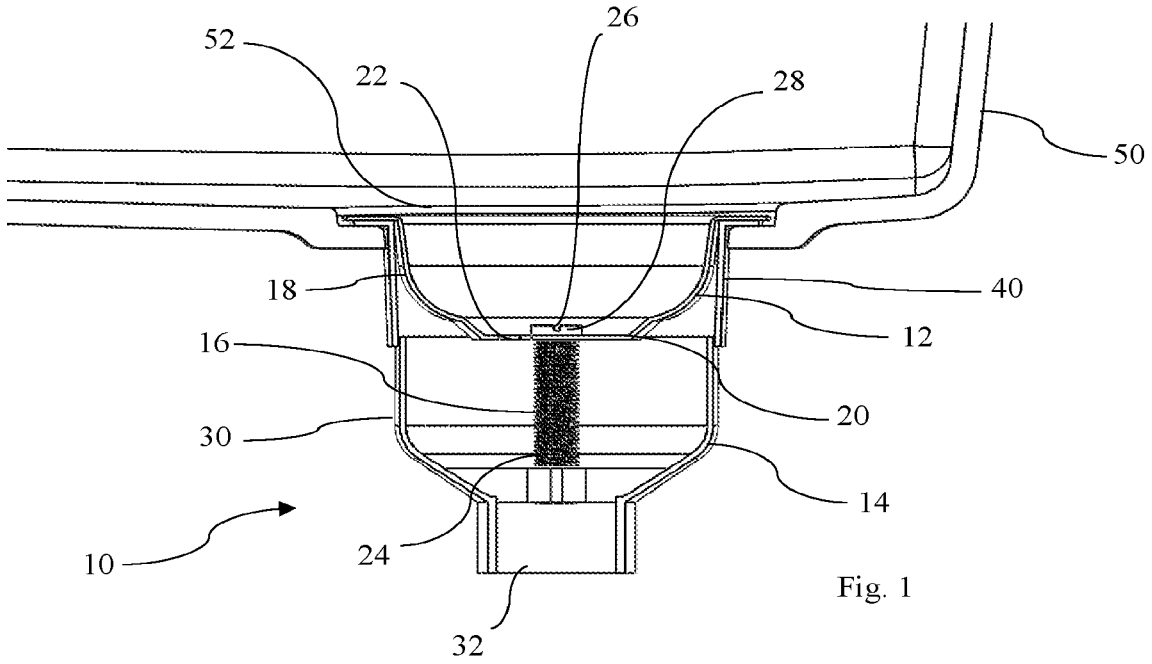
FIG. 1 shows a sectional view of a waste outlet device in accordance with a first embodiment of the present invention.
Figure 2:
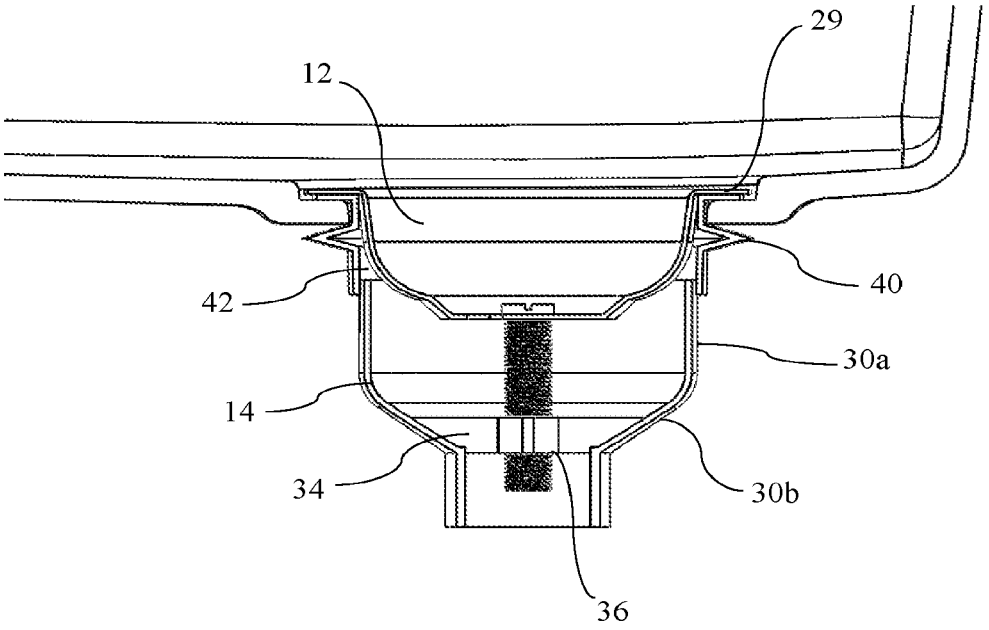
FIG. 2 shows a further sectional view of the waste outlet of FIG. 1.

FIGS. 1 and 2 show a waste outlet device 10 comprising a top section 12 and a bottom section 14, both of which are mounted upon an elongate rigid shaft 16.

The top section 12 is in the form of a concave cup shape having an arcuate side wall 18 that leads down to a drain aperture 20 at the lowest part thereof. The drain aperture 20 is provided with a strainer section 22 having an aperture in the centre, through which passes the elongate rigid member 16, which is in the form of a threaded bolt 24 that has a slot 26 in the head 28 thereof. The internal surface of the aperture of the strainer section 22 is shaped to allow the threaded bolt 24 to rotate freely therein, although it will be appreciated that the internal surface could be threaded in some arrangements. The head 28 of the threaded bolt 24 is positioned adjacent the strainer section 22 and within the concave cup shape of the top section 12. The shaft of the bolt 24 extends through the strainer section 22 and away from the head 28. A radially extending flange section 29 is positioned at the top of the side walls 18.

The bottom section 14 comprises a funnel-like shape having a side wall 30 and a drain outlet aperture 32 at the lowest part thereof. The side wall 30 of the bottom section has a straight section 30*a* and an arcuate section 30*b* that creates the funnel shape. Affixed to the side wall 30 and within the concave shape is a support section 34, with the support section 34 having a hole 36 therein that is provided with an internal threaded section.

One end of a tubular seal 40 having an internal channel 42 is attached, preferably by adhesive, although it could be heat sealed or otherwise attached, to the periphery of the bottom section at a position on the side wall 30 that is distal from the drain outlet aperture 32. The tubular seal 40 is, preferably an elastomeric material, although other materials may be employed, that can be concertinaed or compressed. The tubular seal 40 may be provided with ridges or ribs (not shown) that ensure that it compresses in a known manner such that the 'folds' of material extend radially so that the width of the tubular seal, or its diameter, increases whilst not impinging upon its internal channel.

To assemble the waste outlet device 10, the bottom section 14 is connected to the top section by mounting the threaded section of the support section 34 upon the threads of the bolt 24 that extends from the top section 12. Thus, the top section 12 and the bottom section 14 are arranged coaxially with one another. The second end of the tubular seal 40 is placed around the outlet of the top section 12. The section end of the tubular seal 40 may be affixed to the external surface of the top section 12 to reduce the risk of fluid leaking out from between the top section 12 and the bottom section 14; however, the top section 12 can be placed adjacent the second end of the tubular seal 40 without being affixed thereto.

The position of the bottom section 14 relative to the top section 12 can be adjusted by rotation of the bolt 24. Rotation of the threaded bolt 24, which engages with the threads within the support section 34 of the bottom section 14 results in movement of the bottom section 14 along the length, or shaft, of the bolt 24. It will be understood that as the bottom section 14 is moved away from the top section 12, the tubular seal will be pulled, or stretched, into an extended position. Similarly, as the bottom section 14 is moved towards the top section 12, the tubular seal 40 will be crumpled, concertinaed or compressed. As discussed herein, the tubular seal 40 is designed to ensure that the internal channel therein is not impinged or obstructed when it is compressed.

To install the waste outlet device 10 in a product 50 that has a waste aperture 52 therein, the waste outlet device 10 is placed into the extended position with the top section 12 and the bottom section 14 spaced apart sufficiently that the bottom section 14 and the tubular seal 40 are of a substantially similar width or diameter, and wherein that diameter is less than the diameter of the waste aperture of the product 50. As the tubular seal 40 may be a flexible material, its width or diameter may be slightly larger than that of the bottom section. The bottom section 14 and the majority of the tubular seal 40 are then both placed within the waste aperture 52, such that the bottom section 14 is on the opposite side of the waste aperture 52 than the top section 12. Once the top section 12 and the bottom section 14 are on opposing sides of the waste aperture 52, a tool (not shown) is used to engage the slot 26 in the head 28 of the bolt 24 and to rotate the bolt 24 in order to move the bottom section 14 towards the top section 12, thereby compressing the tubular seal 40. The tubular seal 40 compresses in such a manner than its width is increased, which, when the bottom section 14 is brought sufficiently close to the top section 12, is larger than the diameter of the waste aperture 52. As the diameter of the tubular seal 40 is larger than the diameter of the waste aperture 52, the waste outlet 10 is locked onto the product 50. The drain outlet aperture 32 of the bottom section 14 can be connected to a pipe, drain or other wastewater disposal.

To remove the waste outlet 10, the bolt 24 is rotated to move the top section 12 away from the bottom section 14 to extend the tubular seal 40 and reduce its diameter, thereby enabling it to be pulled through the waste aperture 52.

When installed, the bottom of the top section 12 sits within the top of the bottom section 14 with the tubular seal surrounding those parts. Thus, water is able to flow from the inlet of the top section 12, through top section 12 and out of the outlet thereof, an subsequently into the inlet of the bottom section 14 and therethrough, leaving from the outlet of the bottom section, from which it then passes through the drain outlet aperture 32 and way from the product in which it is installed. Therefore, the top section 12 is in fluid communication with the drain outlet aperture 32 and the tubular seal 40 reduces the risk of leakage from the waste outlet device 10.

Figure 3:
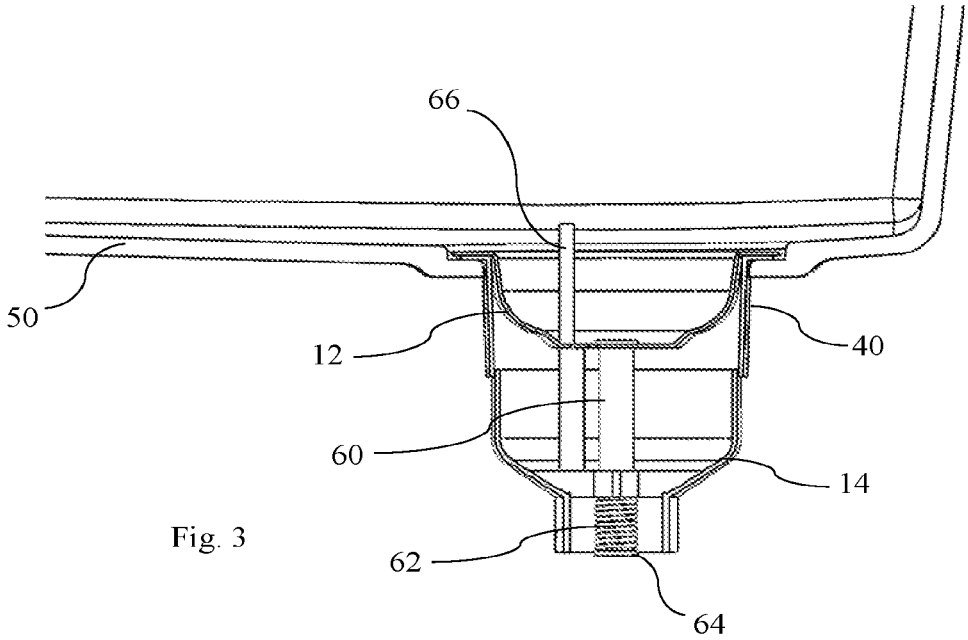
FIG. 3 shows a sectional view of a waste outlet in accordance with a second embodiment of the present invention.
Figure 4:
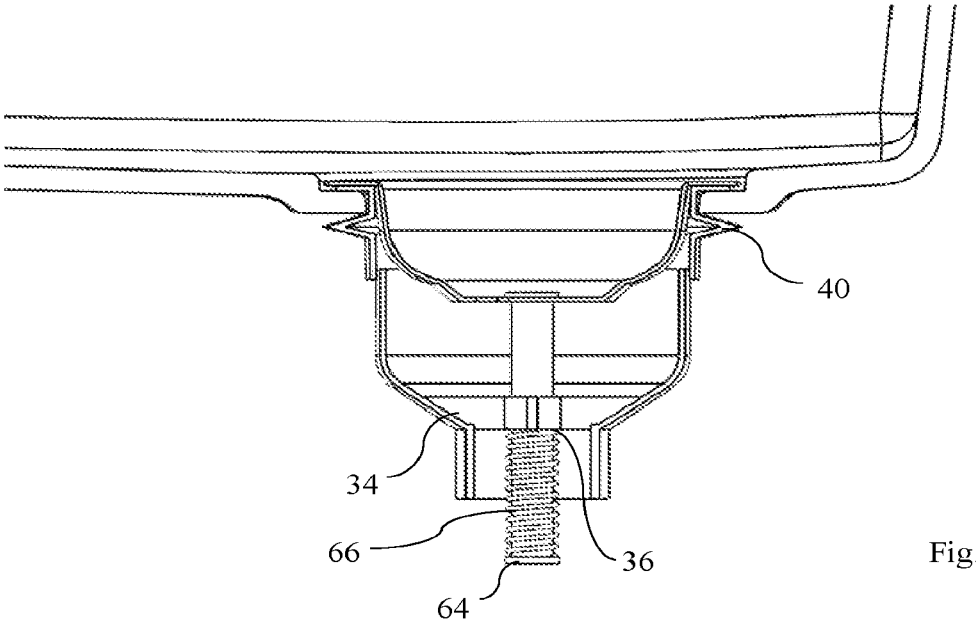
FIG. 4 shows a further sectional view of the waste outlet of FIG. 3.

FIGS. 3 and 4 show a second embodiment of the invention that is a similar arrangement to that shown in FIGS. 1 and 2; however, the bolt 24 is replaced by an elongate rigid shaft 60 and a compression spring 62 therearound. Numbering of the device shown in these figures is consistent with that of FIGS. 1 and 2, where possible.

The top section 12, the bottom section 14 and the tubular seal 40 are the same as the embodiment of FIGS. 1 and 2. The elongate rigid shaft 60 is mounted upon the strainer section 22 of the top section 12 and the bottom section 14 is mounted upon the same elongate shaft 60 by placing the elongate shaft within the hole 36 of the support section 34, such that the bottom section can move axially along the elongate shaft 60. The end of the elongate shaft 60 that is distal from the top section 12 is provided with a stopper element 64. The compression spring 62 is arranged around the elongate rigid shaft 60 and between the stopper element 64 and the underside of the bottom section 14. Thus, the compression spring 64 biases the bottom section 14 towards the top section 12, with the tubular seal 40 in the compressed position.

To install the waste outlet device of the second embodiment, a tool 66 is passed though the strainer section 22 of the top section 12 and that tool 66 presses against the support section 34 of the bottom section 14. The force of the tool 66 pressing against the bottom section 14 compresses the compression spring 62, thereby extending the tubular seal 40 and reducing its diameter. The waste outlet device can then be installed into an aperture in a product. Once in place, the tool 66 is removed from the waste outlet device and the compression spring 66 extends to force the bottom section 14 towards the top section 12, thereby expanding the tubular seal 40 and fixing the device in place.

Figure 5:
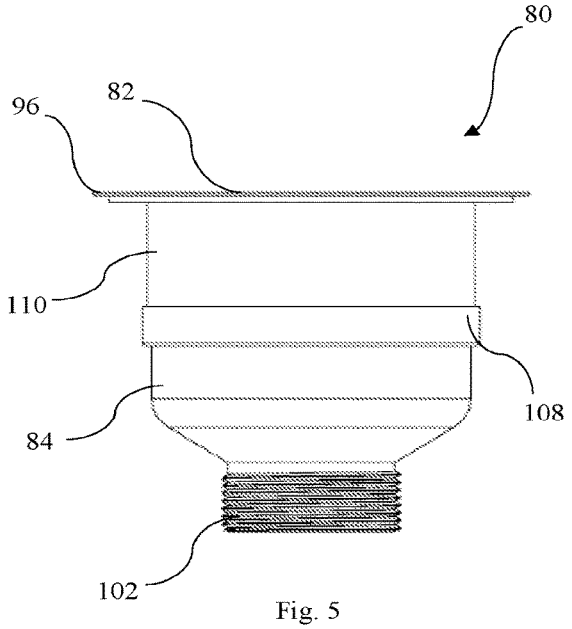
FIG. 5 shows a side view of a second embodiment of the waste outlet of the present invention.
Figure 6:
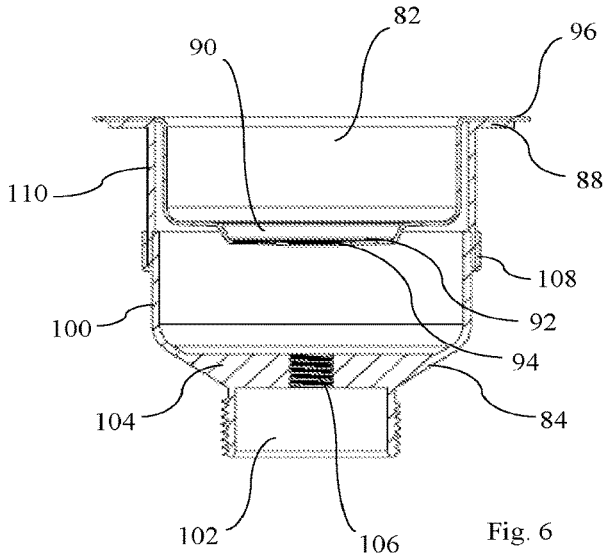
FIG. 6 shows a sectional view of the waste outlet of FIG. 5.

FIGS. 5 and 6 show a waste outlet device 80, similar to that shown in FIGS. 1 and 2. The waste outlet device 80 has a top section 82 and a bottom section 84, both of which can be mounted upon an elongate member. Whilst the elongate member is not shown in FIGS. 5 and 6, it will be appreciated that the respected parts are mounted upon the elongate member in the same manner as that shown in the other embodiments.

The top section 82 in the form of a concave cup shape having a side wall 88 that leads down to a drain aperture 90, which has a strainer section 92 therein. The strainer section 92 has an aperture 94 therein with substantially smooth internal walls. A radially extending flange section 96 is arranged at on the side wall 88 of top section 82.

The bottom section 84 comprises a funnel-like shape having a side wall 100 and a drain outlet aperture 102 at the lowest part thereof. A support section 104 is positioned between the inlet of the bottom section and the outlet aperture 102 and the support section 104 has a threaded aperture 106 therein. The support section 104 can be a single bar across the bottom section 84, or it may be a strainer with multiple bars and apertures therein. A U-shaped channel 108 surrounds the side wall 100 of the bottom section 84 and is preferably coaxial therein.

A first end of a tubular seal 110 is inserted into, and sits within, the U-shaped channel 108 and the tubular seal extends beyond the top surface of the bottom section 84. The tubular seal 110 may have a radially extending flange section at the second end thereof, and it will be appreciated that the first end may be provided with similar.

As with the other embodiments, the first section 82 and the second section 84 are mounted on an elongate member. In the extended position, the tubular seal 110 has a diameter sufficient to pass through an aperture in a surface to which the waste outlet device 80 is being fitted, for example, a sink, a shower tray or a bathtub, with the top section 82 arranged on a first side and the bottom section 84 positioned on a second, opposing side. Once, in place, the first section 82 and second section 84 are brought closer to one another, the tubular seal 110 is compressed and so extends outwardly on the second side of the surface. Thus, the radially extending flange 96 of the top section 82, which has a larger diameter than the aperture into which the waste outlet device 80 is being fitted, is adjacent the first side of the surface, with the radially extending part of the tubular seal 110 sandwiched between the flange 96 of the top section 82 and the surface. On the second side, the bottom section 84 is adjacent the surface in which the device 80 is being fitted and the compressed and expanded tubular seal 110 is sandwiched between the bottom section held tightly adjacent the surface and the bottom section 84 and the second side of the surface.

When brought tightly together on respective sides of the surface, the radially extending flange 96 expands and is sandwiched between the top section and the bottom section with the surface therebetween. Due to the forces involved, a tight seal is created between the first end of the tubular seal 110 and the U-shaped channel 108 and between the second end of the tubular seal 110 and the radially extending flange 96 of the top section 82.

Figure 7:
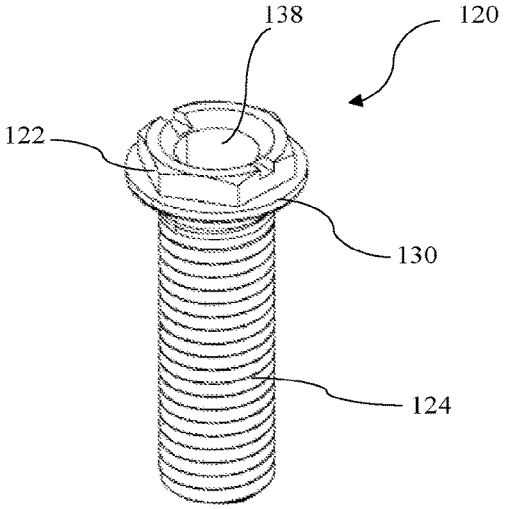
FIG. 7 shows a perspective view of bolt for use with the present invention.
Figure 8:
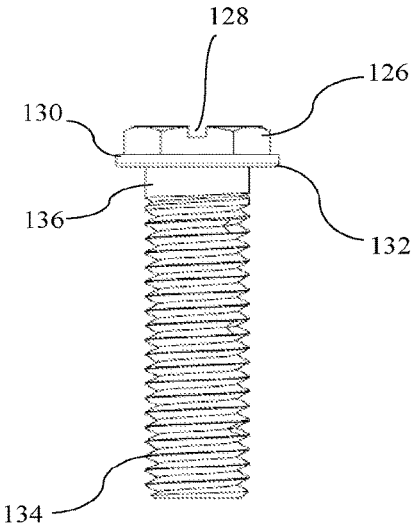
FIG. 8 shows a side view of the bolt of FIG. 7.
Figure 9:
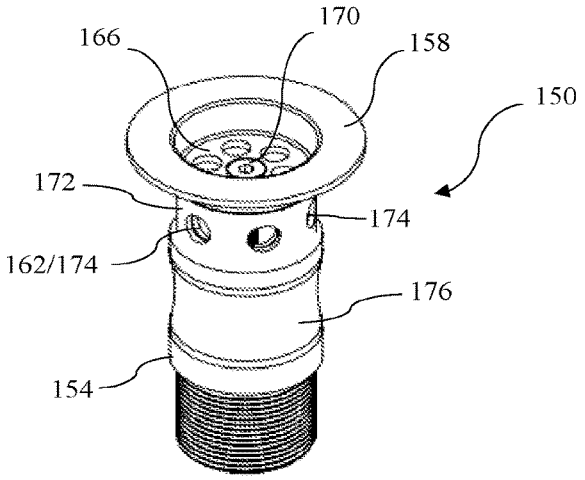
FIG. 9 shows a perspective view of a further embodiment of the present invention.
Figure 10:
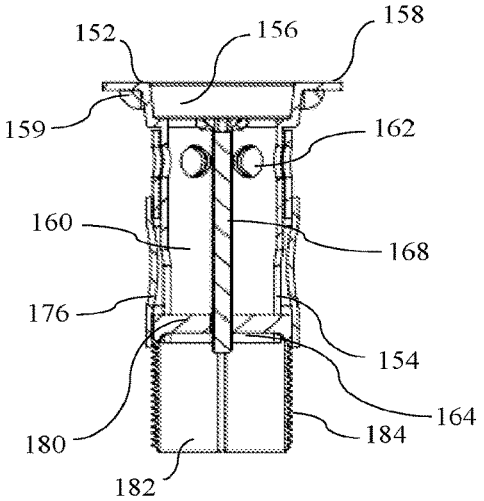
FIG. 10 shows a cross-sectional view of the device of FIG. 9 in a first position.
Figure 11:
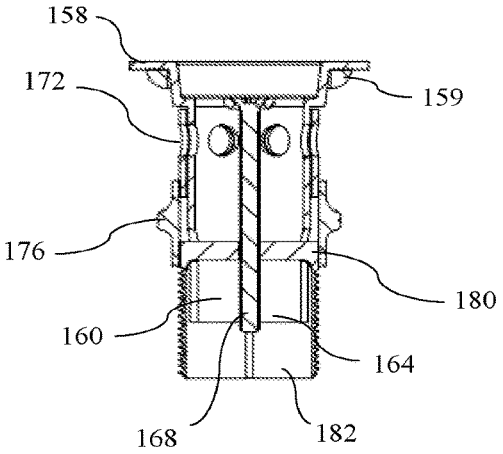
FIG. 11 shows a cross-sectional view of the device of FIG. 9 in a second position.
Figure 12A:
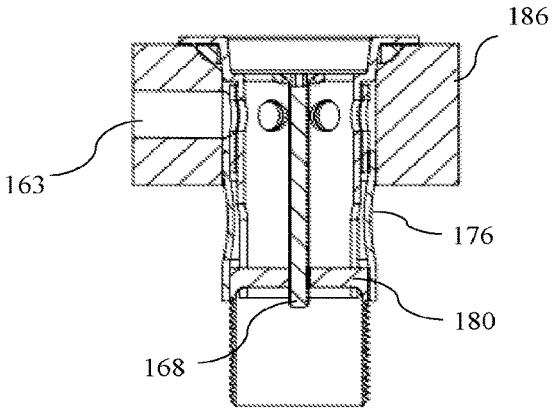
FIG. 12A shows a first step of the device of FIG. 9 being installed in a sink with an overflow arrangement.
Figure 12B:
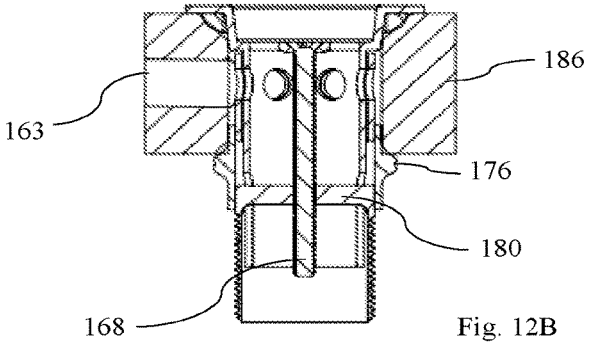
FIG. 12B shows a second step of the device of FIG. 9 being installed in a sink with an overflow arrangement.
Figure 14A:
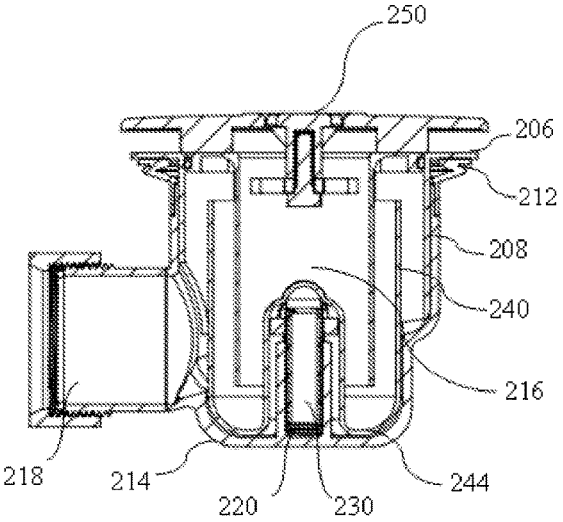
FIGS. 14A and 14B show the embodiment of FIG. 13 in a second position.

FIGS. 7 and 8 show a bolt 120 having a head section 122 and a shaft section 124. The head section has a hexagonal profile 126 for receiving a spanner and a slot 128 for receiving a flat-head screwdriver. It will be appreciated that other shapes may be employed for these profiles, such as a hexagonal internal profile for receiving a hex-key and/or a cross-headed screwdriver. The head section 122 is provided with a peripherally extending skirt 130, which has a radius 132 on the underside. The shaft section 124 is provided with an external thread 134, with an unthreaded section 136 adjacent the head section 122, thereby allowing the bolt 120 to rotate smoothly within the top section. A channel 138 passes through the centre of shaft section 124 to allow fluid to pass through the bolt 120.

FIGS. 9 to 12B show a further waste outlet arrangement 150, having a top section 152 and a bottom section 154. The arrangement 150 is more suited to installation in a bath or sink that has an overflow outlet to allow water to pass through the outlet of the bath or sink should the water receiving part thereof become too full.

The top section 152 has a cup-like portion 156 that has an aperture therein and that has a radially extending flange 158, the flange 158 extending around the top surface of the cup-like portion. A skirt section 160 extends axially from the cup-like portion 156 in a direction away from the flange 158. Thus, the top section 152 has an elongate axial extension, which is provided with apertures 162 therein, that allow fluid communication from outside the skirt section 160 into the skirt section 160. As a result, the top section 152 has a first inlet in the form of an aperture in the cup-like portion 156 to allow water from a sink or path to drain through, and a second inlet in the form of apertures 162 in the skirt section 160 to allow water from an overflow 163 to pass into the top section 152. Positioned between the skirt section 160 and the flange 158 is a seal 159.

The end of the skirt distal from the flange 158 constitutes an outlet 164 of the top section 152. The top section 152 further comprises a strainer element 166 with an aperture therethrough for receiving a bolt 168. A head 170 of the bolt 168 is wider than the aperture of the strainer element 166. The shaft of the bolt 168 has an external thread along at least part of its length.

The bottom section 154 comprises a substantially rigid cylindrical element 172 that is provided with apertures 174 in its wall, the cylindrical element 172 being attached to the first end of a tubular seal 176. The tubular seal 176 extends axially and the second end of the tubular seal 176 is connected to an outlet element 178, which comprises a support section 180. The support section 180 has an aperture therein for receiving the bolt 168, with the aperture having an internal thread that can engage with the external thread of the bolt 168. The outlet element 178 of the bottom section 154 may be connected to, or integral with, an outlet pipe 182. The outlet pipe may further be provided with a threaded section 184, preferably, an external threaded section, to allow the outlet of the bottom section 154 to be connected to a drainpipe.

To install the waste outlet device 150, the top section 152 and the bottom section 154 are mounted on the bolt 168 in a first, extended position, in which the tubular seal 176 is extended. The skirt section 160 extends towards, and into the cylindrical element 172 of the bottom section 154, which the tubular seal 176 surrounding the outlet of the top section 152 and the inlet of the bottom section 154. The apertures 162 of the skirt section 160 and the apertures 174 of the cylindrical element 172 are lined up, which may be undertaken by way of one or more protrusion and recess, or groove, on the respective parts.

When in the top section 152 and the bottom section 154 are mounted on the bolt 168 and the device 150 is in the extended position, the device is fed into the sink, bath, shower tray or other element 186 into which it is being fitted. Once the top section 152 is on one side of the surface into which the device 150 is to be fitted, and the bottom section 154 is on the other side of the surface, the bolt 168 is rotated to draw the support section of the bottom section 154 towards the top section 152. This compresses the tubular seal 176, and, due to the skirt of the top section 152, the tubular seal 176 expands radially outwards. The seal 159 of the top section 152 provides a seal between the device 150 and the first surface of the item into which the device 150 is being fitted and the expanded tubular seal 176 provides a seal between the second surface of the item into which the device 150 is being fitted.

It will be appreciated that once the device 150 is installed in its compressed state, the seal 159 of the top section 152 and the tubular seal 176 of the bottom section 154 reduce the risk of water egress. Any water flowing from the sink or bath into which the device may be installed will pass through the cup-like inlet 156 of the top section and through to the bottom section 154. Similarly, water passing through the overflow 163 of the bath or sink 186 will pass through the lined-up apertures 162/174 and through to the bottom section 154.

FIGS. 13A to 14B show an embodiment of the present invention that is suitable for installation in a shower tray. The waste outlet device 200 has a top section 202 having an inlet 204 and radially extending flange 206 at the top of the inlet 204. Extending axially from the flange 206 is an outer skirt element 208 that extends axially from the top section 202 to create a tubular outlet to the top section 202. The top section 202 has an inlet 210 into which wastewater can pass. A crossbar (not shown) is provided across a diameter of the outer skirt element 208, which has a connecting aperture therein. Substantially coaxial with the outer skirt element 208 and surrounding the same is a first end of a tubular seal 212. The tubular seal 212 encloses the outlet of the top section 202. The tubular seal 212 can be arranged that it is positioned under the flange 206, and, in one arrangement, a portion of the tubular seal 212 also extends radially.

The device 200 further comprises a bottom section 214 that is connected to the second end of the tubular seal 212, with the tubular seal 212 encompassing the inlet 216 to the bottom section 214. Thus, water can pass from the top section 202 into the bottom section 214 via the tubular seal 212. The bottom section 214 has an outlet 218 that is arranged to be non-parallel, or radial, to the axis of the inlet 216. As a result, any water flowing into the bottom section 214 from one direction is redirected in a different direction. The bottom section 214 has a connecting recess 220 therein that constitutes a support section. The support section, or connecting recess 220, is provided with an internal threaded portion 222 that can receive a bolt therein.

Figure 13A:
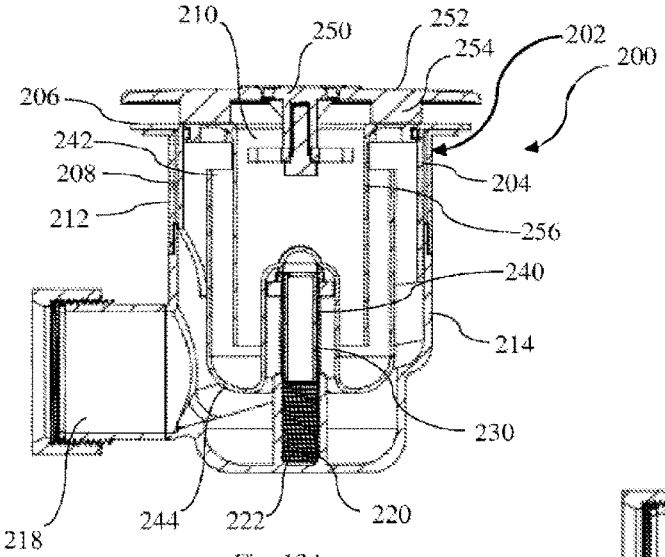
FIGS. 13A and 13B show another embodiment of the present invention in a first portion.
Figure 13B:
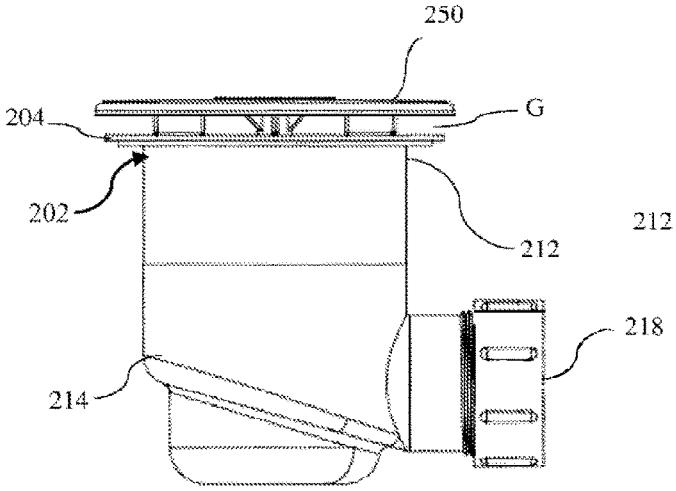
Figure 14B:
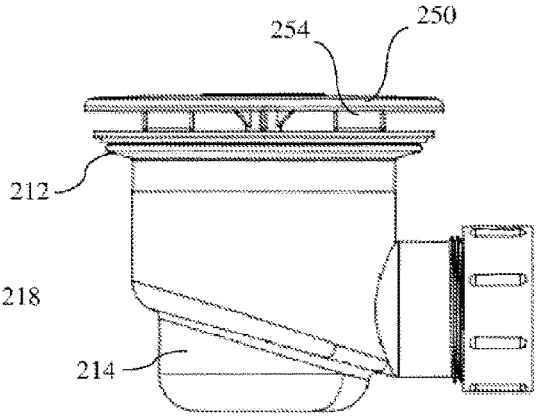

To install the device 200, the device is put into the position shown in FIG. 13 and it is inserted into an aperture in a shower tray. Subsequently, a threaded bolt 230 is passed through the connecting aperture in the crossbar of the top section 202 and the bolt is received, and engages with, the connecting recess 220 in the bottom section 214. Upon tightening of the bolt 230 the top section and the bottom section are brought towards one another, which compresses the tubular seal 212. As the tubular seal is compressed, it expands radially, and the tubular outlet 210 of the top section 202 ensures that when the tubular seal 212 is compressed during fitting, the seal 212 cannot compress inwardly and so it expands radially outwards from the device 200. This ensures that the seal does not impede the internal flow path of the device 200. It will be noted that where the tubular seal 212 extends radially adjacent the flange 206, upon installation, it will be compressed between the flange 206 and the shower tray, thereby forming a seal.

Once the top section 202 and the bottom section 214 are connected in the shower tray, an insert 240 is provided. The insert 240 is in the form of a cup element, having an open upper face 242 and a closed lower face 244. The insert 240 has an "n-shaped" recess so that it can sit upon the cross bar of the top section 202. The insert 240 sits over the crossbar of the top section 202 and extends to sit cover the head of the bolt 230.

Once the insert 240 is within the device 200, a top cap element 250 is placed into the top section 202 of the device 200. The cap element 250 comprises a top surface 252 and a spacer element 254, so that the top cap element 250 engages with, and sits proud of, the top section 202, and creates a gap G between the flange 206 and the cap element 208, which allows water ingress into the top section 202 from a radial direction and or the axial direction. The top surface 252 may be provided with at least one aperture therein to allow water to pass through the top surface of the cap element 250. The cap element 250 further comprises an inner tubular conduit 256 extending into the top section 202. The inner tubular conduit 256 extends into the top section 202 and into the insert 240, and so has a slot to receive the crossbar of the top section 202.

The inner tubular conduit 256 creates a channel through which water can pass. Thus, when installed, water passes between the top surface 252 of the top cap element 250 and the flange 206 of the top section 202. It then passes through the inner tubular conduit 256 and into the insert 240. As the insert 240 is cup-like, it fills with water and subsequently, when full, the water passes over the top of the insert and into the bottom section of the device 200. In doing so, the water then exits the device 200 through the outlet 218 and into any waste pipe that is connected thereto. The use of the insert creates a "U-bend" in the waste outlet 200 that allows a predetermined amount of water to be held in the device 200, thereby creating a seal to prevent odours passing from the drain and through the top section of the device 200.

Further adaptations may be included in the device set out herein. For example, it will be appreciated that a compression spring arrangement may be used in combination with the threaded bolt to provide a failsafe should the respective threads of the bolt and the bottom section disengage. Thus, the compression spring will assist with keeping the waste outlet device locked in place.

Whilst the invention set out herein is described in relation to sinks, basins, baths and showers, it could be applied to other situations, such as drains, containers and other applications where waste liquid is drained.

The head of the bolt may be removeable to reduce the risk of the waste outlet device being removed or loosened unintentionally. This is particularly beneficial where the bolt is provided with a channel therethrough to allow the flow of fluid through the bolt.

The tubular seal of the present invention may be in the form of telescopic elements that extend to form the tubular shape, or as referenced above, it may be constructed from a flexible material that is able to contract or compress in a known manner, whilst ensuring that its internal channel is sufficiently clear to allow the flow of fluid, particularly wastewater therethrough.

The invention has been described in relation to a threaded mechanism and a spring bias; however, the adjustment, manipulation or other movement of the relative parts may be put into effect by way of a ratchet mechanism, magnets, a rack and pinion arrangement or a further adjustment mechanism.

The top section, the tubular seal and the bottom section may be provided as separate elements that are connected to one another before installation of the waste outlet. In a preferred arrangement, the tubular seal may not be affixed to the top section, but instead it may be sandwiched between the radially extending flange of the top section and the product to which it is being installed. Due to the force created by the adjustment mechanism, for example the threaded sections when tightened, the flange may clamp down onto the seal to provide a sufficient seal between the respective parts.

The support section of the bottom section may be in the form of a second strainer element.

The internal shape of the top section may be sized and shaped to receive a plug, thereby enabling the top section to be blocked to retain water in a basin, sink or bath.

The outlet of the bottom section may be axial with the inlet, or it may be radial to the axis of the inlet to the bottom section. For example, it may be desirable to have the water enter the waste outlet from the top, but the water exist the water outlet sideways or in a direction that is not coaxial with the inlet.

Guides or slots and protrusions may be employed in the respective parts to reduce the risk of unwanted rotation therebetween.

The threaded bolt may be replaced with a different connection mechanism, for example, a bayonetted fitting that will connect the relevant parts.

An insert may be applied to any of the embodiments, particularly where a seal against odour may be required.

Features of one or more embodiment set out herein may be included into other embodiments set out herein.

The invention claimed is:

1. A waste outlet having:

a top section with an inlet and an outlet, the inlet and the outlet of the top section being in fluid communication with one another, and the top section being provided with a radially extending flange; and a bottom section with an inlet and an outlet, the inlet and the outlet of the bottom section being in fluid communication with one another, with the bottom section further having a support section therein;

wherein the top section and the bottom section are both arranged upon a elongate member, wherein the elongate member has a channel therethrough, wherein a tubular seal element encloses the outlet of the top section and the inlet of the bottom section, and wherein the top section and the bottom section are arranged on the elongate member such that the distance between the respective sections can be adjusted.

2. A waste outlet according to claim 1, wherein the tubular seal is an elastomeric material.

3. A waste outlet according to claim 1, wherein the elongate member has a head section and a stem section and part of the head section adjacent the stem is provided with a flange or skirt.

4. A waste outlet according to claim 1, wherein the top section is provided with an aperture through which the elongate member can pass.

5. A waste outlet according to claim 1, wherein the bottom section is provided with a U-shaped rim surrounding the inlet of the bottom section, and one end of the tubular seal sits within the U-shaped rim.

6. A waste outlet according to claim 1, wherein the tubular seal is fixedly connected or integral with the bottom section.

7. A waste outlet according to claim 1, wherein the elongate member is provided with an external threaded portion and at least one of the bottom section and the top section is provided with a corresponding threaded section such that rotation of the elongate member adjusts the position on the elongate member of the top section and/or the bottom section relative to the other of the top section and the bottom section.

8. A waste outlet according to claim 7, wherein the elongate member is provided with an aperture or recess in which to receive a tool to rotate the elongate member.

9. A waste outlet according to claim 1, wherein the tubular seal has an extended position when the top section and bottom section are spaced apart, and a compressed position in which the top section and bottom section are brought closer to one another to compress the seal section and wherein, when in the compressed position, the seal has a larger width than when in the extended position.

10. A waste outlet according to claim 9, wherein the waste outlet is biased into either the compressed position or the extended position.

11. A waste outlet according to claim 10, wherein the bias is a spring-bias.

12. A sink, shower tray or bath having a waste outlet according to claim 1.

13. A method of installing a waste outlet comprising the steps of:

providing a waste outlet according to claim 1;

putting the waste outlet into the extended position;

placing the waste outlet device into an aperture with the lower section on one side of the aperture and the upper section on the opposite side of an aperture; and adjusting the waste outlet into the compressed position.

* * * * *